United States Patent [19]

Licata

[11] 4,073,671

[45] Feb. 14, 1978

[54] COLOR FILLING INDICIA SIMULTANEOUSLY WITH DEBOSSING

[75] Inventor: Aurelio William Licata, New Haven, Conn.

[73] Assignee: Seton Name Plate Corporation, New Haven, Conn.

[21] Appl. No.: 631,814

[22] Filed: Nov. 14, 1975

Related U.S. Application Data

[63] Continuation-in-part of Ser. No. 430,092, Jan. 2, 1974, abandoned.

[51] Int. Cl.[2] ..... B31B 31/00

[52] U.S. Cl. ..... 156/219; 29/469.5; 40/2 R; 156/234; 156/261; 156/265; 156/289; 156/298; 428/67

[58] Field of Search ..... 156/219, 220, 251, 261, 156/265, 298, 299, 289, 514, 515, 303.1, 209, 234, 235, 238, 528; 29/469.5; 40/136, 2 R; 428/67, 201, 202

[56] References Cited

U.S. PATENT DOCUMENTS

| | | | |
|---|---|---|---|
| 2,404,073 | 7/1946 | Karfiol et al. | 156/219 |
| 2,477,300 | 7/1949 | Karfiol et al. | 156/220 |
| 2,969,300 | 1/1961 | Franz | 156/261 |
| 3,444,032 | 5/1969 | Kreier, Jr. | 156/289 |
| 3,520,751 | 7/1970 | Cranfill | 156/261 |
| 3,629,042 | 12/1971 | Cranfill | 156/298 |

*Primary Examiner*—William A. Powell

*Attorney, Agent, or Firm*—Wooster, Davis & Cifelli

[57] ABSTRACT

Color-filled debossed indicia are provided on metal substrates. Colored tape comprising a layer of resinous film and a layer of thermoset adhesive wherein the film may be colored, the adhesive may be colored, or an additional layer of acrylic paint may be provided between the film and the adhesive, is interposed between indicia dies and the metal substrate during debossing. A portion of tape corresponding to the indicia is sheared away and deposited on the surface of the indicia. The conversion of kinetic energy to heat during the debossing operation is sufficient in some applications to permanently bond the tape to the metal substrate by means of the thermoset adhesive. If necessary, the tape may be heat treated and cooled to permanently bond the tape to the metal substrate.

5 Claims, 6 Drawing Figures

Fig. 1
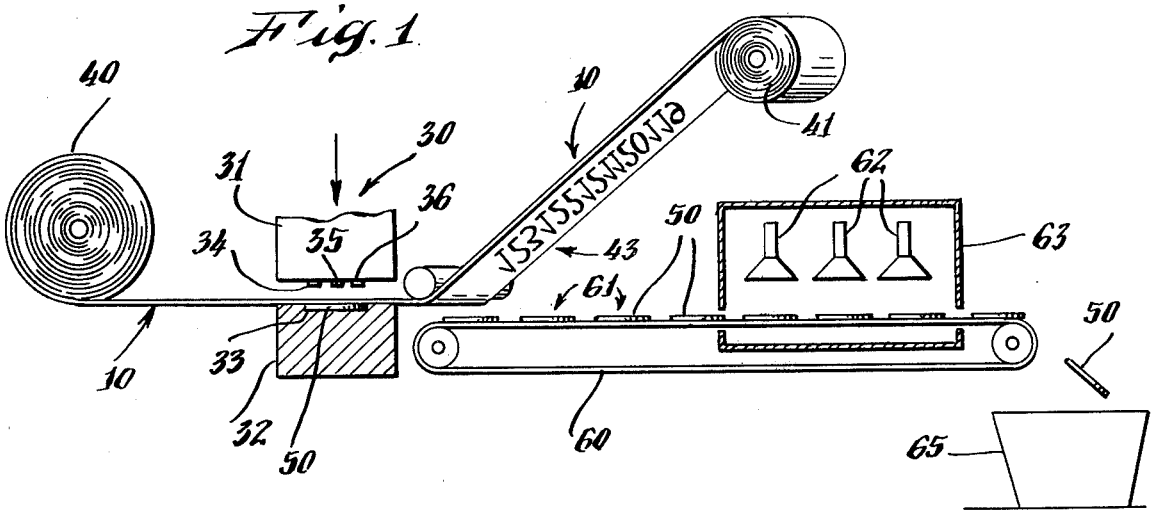
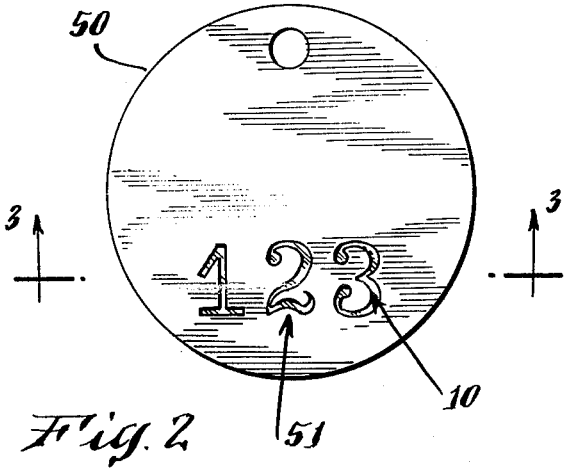
Fig. 2
Fig. 4.
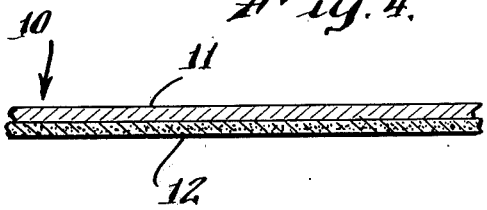
Fig. 5.
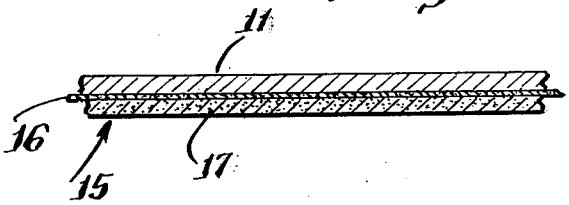
Fig. 6.
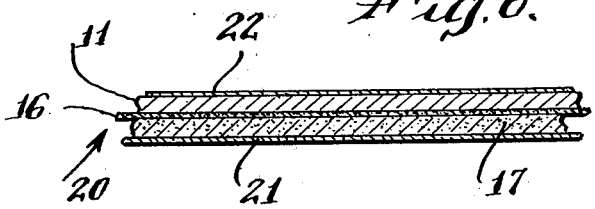
Fig. 3.
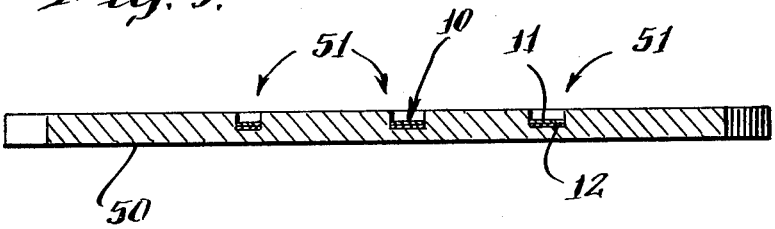

COLOR FILLING INDICIA SIMULTANEOUSLY WITH DEBOSSING

This application is a continuation-in-part of my application Ser. No. 430,092, filed, Jan. 2, 1974, now abandoned.

BACKGROUND OF THE INVENTION

1. Field of the Invention

This invention relates to providing color-filled indicia on various substrates, and to a method and materials for color filling indicia on substrates simultaneously with debossing the indicia thereon. More particularly, this invention relates to color filling indicia on metal tags simultaneously with debossing the indicia thereon by interposing a colored tape comprised of a layer of resinous film, and a layer of thermoset adhesive between the tag and the press used for debossing, wherein a portion of the colored tape is sheared off and positioned on the debossed indicia. The conversion of kinetic energy to heat during the debossing operation is sufficient in some applications to permanently bond the tape to the metal substrate by means of the thermoset adhesive. If necessary, the tape may be heat treated to permanently affix it thereto.

2. Prior Art

Color filling of debossed indicia on substrates such as metal identification tags has been accomplished by flooding the indicia with paint and wiping away the excess, thereafter permitting the paint to dry. Paint filling of debossed indicia has always been a "hand" operation, and is accordingly slow and expensive in terms of labor costs. Furthermore, quality control of tags with paint-filled debossed indicia is difficult to achieve in that the paint usually does not evenly fill the indicia, resulting in ragged edge definition and thin areas which may quickly chip away.

Various processes for providing colored indicia are known, but are not suitable for use on metal substrates. For instance, there is a hot stamp process for initialing plastic goods wherein a heated indicia die is pressed against the plastic with a tape interposed therebetween. The tape is a carrier of a powdered pigment, and the heat from the die causes the pigment and the plastic to melt, wherein the pigment is absorbed by the plastic to form a colored indicia thereon. This process is also useful on leather, wood, and cardboard substrates.

Therefore, despite the long-felt need for a mechanized or automated means of color-filling indicia on metal substrates, such as tags, manufacturers thereof have been forced to rely on hand paint filling techniques. To applicant's knowledge, paint filling is the exclusive technique used today.

SUMMARY OF THE INVENTION

The invention herein fulfills a need which the prior art has not been able to satisfy, i.e. mechanized color filling of debossed indicia on metal substrates. This is accomplished by introducing a colored tape between an indicia die head and the metal substrate during debossing by stamping. The colored tape comprises a resinous film with a thermoset adhesive applied to one side thereof. Under pressure of the debossing operation, the tape is sheared to the shape of the indicia and is deposited over the area of the indicia. The heat generated by the debossing operation is, in many instances, sufficient to melt the thermoset adhesive, which thereafter dries to secure the colored tape permanently on the surface of the debossed indicia. However, a heating operation after the debossing operation may be necessary to melt the thermoset adhesive, which dries to permanently secure the colored tape on the surface of the debossed indicia.

The resultant color-filled debossed indicia are of excellent quality. Sharp resolution at the outline of the color is obtained, and the color filling is chip resistant and otherwise durable. The process of color filling is simple and fast, and hand filling operations are eliminated entirely.

OBJECTS

It is a principal object of this invention to efficiently color fill debossed indicia on substrates.

It is another object of the invention to provide color-filled debossed indicia which are legible, attractive, and durable.

It is a further object of the invention to provide a method of color filling indicia on substrates sumultaneously with debossing.

It is an additional object of the invention to provide colored tapes useful in carrying out the above objects.

Other and more particular objects of the invention will in part be obvious and will in part appear from a perusal of the following description of the preferred embodiments and the claims, taken together with the drawings.

DRAWINGS

FIG. 1 is a side elevation view of a schematic apparatus and tape for debossing and color filling indicia on metal tags according to the invention herein;

FIG. 2 is a front elevation view of a metal tag having color-filled debossed indicia thereon according to the invention herein;

FIG. 3 is a sectional view of the metal tag taken along the lines 3—3 of FIG. 2;

FIG. 4 is a sectional view of a first embodiment of a tape useful in providing color-filled debossed indicia on metal substrates according to the invention herein;

FIG. 5 is a sectional view of a second embodiment of a tape useful in providing color-filled debossed indicia on metal substrates according to the invention herein; and FIG. 6 is a sectional view of a third embodiment of a tape useful in providing color-filled debossed indicia on metal substrates according to the invention herein.

The same reference numbers refer to the same elements throughout the various Figures.

PREFERRED EMBODIMENTS

The invention herein relates to providing color-filled debossed indicia on metal substrates, and particularly on metal tags wherein the color filling is accomplished simultaneously with debossing. The invention also relates to laminar tapes for interposition between an indicia die and metal substrate during debossing to provide the desired color filling.

Referring first to FIG. 4, there is shown a sectional view of a tape 10 according to the invention herein. The tape 10 comprises a top layer 11 of a resinous film, such as Mylar (polyethylene terephthalate) or polyester. Other resinous films will also suffice, but it is preferred that the film used be resistant to shrinkage upon application of heat, and be well suited for the environment in which the tags carrying the tape in debossed indicia are to be used. The tape 10 further comprises a bottom layer 12 which is thermoset glue. Any thermoset glue which is stable at room temperatures will suffice, and good success has been achieved with adhesive No. 3423 of Mace Adhesives and Coatings Co., Inc. Cromwell, Conn. In most cases it is desirable to provide color-filled indicia, and the color is provided by way of the tape. Organic dyes can be mixed with the thermoset adhesive in layer 12 to provide the color, as can other compatible dyes. The color can also be provided by using a colored resinous film.

A tape 15 comprising another embodiment of the invention is shown in FIG. 5. It also comprises a top layer 11 of resinous film. The thin intermediate layer 16 of tape 15 comprises an acrylic paint which provides the color of the tape. Acrylic paints work well because of their affinity to resinous films, although other paints or color pigments in carriers may be used. The bottom layer 17 of tape 15 is thermoset adhesive. Since tape manufacturers are already skilled in producing multilayer tapes, the tape 15 may prove more economical to manufacture than the two layer tape 10 described above including a dye or pigment mixed with the thermoset adhesive.

Referring now to FIG. 6, a tape 20 comprising a third alternative embodiment is shown. The tape 20 comprises a layer of resin film 11, a layer 16 of acrylic paint, and a layer 17 of thermoset adhesive, these three layers being the same as those described above with respect to tape 15. Alternatively, a single layer of combined thermoset adhesive and dye such as used in tape 10 can be substituted for layers 16 and 17. The tape 20 further comprises a thin layer of pressure-sensitive adhesive 21 applied on the bottom surface of tape 20 adjacent to the layer 17 thermoset adhesive. In some operations, the pressure-sensitive adhesive 21 is useful in initially adhering the tape 20 to the substrate prior to heat treatment. A thin layer 22 of release agent may be applied over the top layer 11 of resinous film to facilitate rolling of the tape 20 without the pressure-sensitive adhesive sticking to the top layer. The thickness of the various layers of the tapes is chosen according to their application, as will be discussed below. It will be appreciated that any desired color can be imparted to the tapes.

Referring now to FIG. 1, there is shown schematically apparatus for debossing color-filled indicia on metal tags. The apparatus comprises a press 30 having a vertically driven ram 31 and a bed 32. The bed 32 may be notched or otherwise provided with means for positioning a metal tag thereon in proper orientation with respect to the ram 31, such as notch 33 for receiving tag 50, as shown.

The ram 31 is provided with means mounting indicia forming dies 34–36 thereon. Preferably the dies can be indexed or otherwise changed quickly to provide for different indicia on sequentially processed tags. The indicia dies may be of the type having a flat surface defining the indicia and a 40 degree side bevel, and dies of this type have been found to perform very well in shearing the tapes.

A roll 40 of tape 10 is mounted on one side of the press, and the tape 10 extends between the tag 50 and the indicia dies 34–36 to an indexing take-up reel 41. The resinous film of the tape is disposed toward the dies 34–36. The take-up reel may be pneumatically driven, or be driven by other suitable means. It preferably indexes the tape 10 after each press stroke by an amount sufficient to remove the used portion of tape 10 from between the dies and the tag.

When the tag 50 and the tape 10 are in place, the press 30 is stroked to partially imbed the indicia dies 34–36 in the tag 50 to thereby deboss indicia thereon. The indicia are preferably debossed to a depth greater than the thickness of the tape, wherein the tape is recessed below the surrounding surface of the substrate. The portions of the tape directly under the indicia dies are sheared away from the surrounding tape by the edges of the dies as they deboss the metal. Therefore, tape having an area which corresponds in size and shape to the debossed indicia is applied to the surface of the indicia. The tape sticks to the debossed indicia on the tag 50, and it is believed that this results from either a residual pressure-sensitive character of the thermoset adhesive or from a partial melting of the thermoset adhesive due to the heat produced in absorbing the kinetic energy of the ram 31 of press 30. In order to insure that the tape does not stick to the indicia dies, it is preferable to spray the indicia dies with a silicone lubricant periodically during the press operation.

After the debossed indicia have been formed on the tag and the tape simultaneously applied thereto, as described above, the tag is removed from the bed 32. The tape 10 is indexed by the take-up reel 41 wherein the used portion of the tape indicated at 43 is removed from between the indicia die and press bed. A new tag may then be placed in the notch 33 in the press bed 32, and, if desired, the indicia dies can be changed, whereafter another debossing operation may take place.

In some instances the melting of the thermoset adhesive resulting from the debossing operation is sufficient to achieve a satisfactory bond between the tape and the juxtaposed surface of the debossed indicia. The thermoset adhesive solidifies and the bond becomes permanent as the tag cools following the debossing operation.

However, an additional heat treatment step may be necessary to insure a good bond in other instances. In such a heat treatment step, a conveyor 60 carries the stamped tags, shown at 61, under a plurality of infrared light sources 62. The tags are oriented with the tape-filled debossed indicia on the "top" surface. The number and position of the infrared light sources 62 is adjusted to provide a temperature of approximately 250° F at the surface of the conveyor belt, and an enclosure 63 surrounding the infrared light sources 62 may be used to confine the heated region. The speed of the conveyor belt 60 is adjusted such that the tags are exposed to the heat for approximately 5 seconds. The heat from the infrared light sources melts the thermoset adhesive which then achieves intimate contact with the tag.

After the tags are carried away from the heat source they may be deposited in a collector hopper 65. The tags cool quickly, whereafter the bond between the thermoset adhesive, the layer 11 of resinous film, and the tag is solidified.

Alternatively, the tags can be collected and heated in a batch. Also, heating apparatus other than infrared light sources may be used to melt the thermoset adhesive.

The indicia dies 34–36 are maintained at approximately room temperature during debossing. Heating of the indicia dies in an effort to heat treat the tape simultaneously with debossing has not proved successful in that the heat conductivity of metal disperses the heat rapidly and causes thermoset adhesive to adhere to the metal surrounding the indicia. However, this problem does not occur when utilizing the heat generated in dissipating the kinetic energy of the press ram to set the thermoset adhesive.

Any of the other tapes disclosed herein can also be used to fill debossed indicia in the same manner as described above with reference to FIG. 1, although the tapes 10 and 15 have proved preferable to tape 20. It should also be noted that the thickness of the various layers of the tapes is chosen with reference to the application for the tape, i.e. when large indicia are being stamped a larger capacity press is used, and a thicker tape is desirable.

For instance, if one to three numbers each ½ inch in size are being debossed onto a brass tag, a 15-ton press may be employed. A suitable tape comprises a resinous film top layer 11, having a thickness of approximately one mil and a layer 12 comprising thermoset adhesive having a thickness of ½ to 1 mil. It has been found that a layer of thermoset adhesive having a thickness toward the thinner end of the ½ to 1 mil range is better adapted to achieving bonding of the tape to the metal substrate by means of the heat generated in the debossing operation alone. When numbers ¼ inch in height are being stamped, a press as small as 1½ ton capacity can be used. A tape comprising a resinous film top layer of ½ mil thickness and a thermoset adhesive layer of ¼ to ½ mil thickness is suitable for numbers of this size, and if tape having layers of too great thickness is used, it may not be completely sheared by the press. Again, the layer of thermoset adhesive should be toward the thin end of the range if it is desired to attempt to avoid a separate heat treatment step. The thickness of the layer 16 of acrylic paint in tapes 15 and 20 is not critical, and because the thermoset adhesive has less shear strength than the resinous film, there is more latitude for varying its thickness. It will be appreciated that the thicknesses of the various layers can be varied according to the parameters of a particular application.

Referring now to FIG. 2, there is shown a tag 50 having color-filled debossed indicia "123" thereon at 51. Tape 10 described above was used to color-fill the indicia, with the color provided by an organic dye mixed with the thermoset adhesive. As best seen in FIG. 3, the indicia are debossed and are filled by the tape 10 with the layer 12 of thermoset adhesive adjacent to the indicia surface and with the layer 11 of the resinous film applied thereover. The indicia are debossed to a depth greater than the thickness of the tape, wherein the tape is recessed from the surrounding surface of the substrate.

The resinous film affords protection of the dye and thermoset adhesive from the environment in which the tag is to be utilized. For instance, if the tag is to be used in or around a swimming pool, the resinous film protects the dye and thermoset glue from the deleterious effects of chemicals such as chlorine. The tapes disclosed herein are also highly chip-resistant, and tags having debossed indicia filled with the tapes may be subjected to much abuse while retaining legibility and good appearance. The tapes shear to conform closely to the outlines of the debossed indicia, and the appearance of the tags with the tape color-filled debossed indicia is superior to the old hand paint filled tags.

The invention disclosed herein is applicable to other uses than those particularly described herein. For instance, the tapes disclosed herein can be used in printing debossed indicia on a plurality of kinds and shapes of substrates. One example is using the tapes to simultaneously deboss and color fill indicia on round objects, such as drills, taps, tools, and the like, by a rolling press operation. In such an application the resinous film of the tapes makes them especially well suited for use around oils, grease, and grime, and for making the indicia easily cleanable. It should be noted that indicia on round surfaces are often not color-filled because of the difficulties in paint filling on round surfaces.

Examples of other substrates onto which the tape may be applied simultaneously with debossing to color fill the debossed indicia include plastics, woods, hard cardboards, and any substrates having sufficient density to generate the shear forces necessary to cut the tape to the shape of the indicia, bearing in mind the thickness of the layers of the tape can be varied.

It should also be noted that the term indicia is to be construed broadly as including numbers, letters, designs, or any arrangement of area capable of being printed. Thus, the tapes could be used in applying decorative color trim to metal plates used on machinery, in automobiles, or in other ways. Of course, the tape may be made in sizes appropriate for the application.

Thus the objects of the invention are believed to be efficiently attained. It will be apparent to those skilled in the art that various modifications and changes may be made in this invention without parting from its spirit and scope. Accordingly, the foregoing description should be construed as illustrative only, rather than limiting.

I claim:

1. A method of forming color-filled debossed indicia on metal substrates comprising:

a. positioning a metal substrate below means including indicia die means for debossing indicia thereon, said indicia die means having a flat indicia-forming surface;

b. interposing a colored tape comprising a layer of resinous film and a layer of thermoset adhesive between the die means and the metal substrate with the thermoset adhesive layer adjacent to the metal substrate;

c. maintaining the metal substrate and tape at a temperature below the melt point of the thermoset adhesive prior to debossing; and d. applying the die means to the tape and metal substrate by stamping with sufficient force to deboss the indicia in the metal substrate and to shear the tape along the outline of the indicia whereby a portion of the tape corresponding to the shape and area of the indicia is sheared away from the surrounding tape and positioned adhered on the surface of the debossed indicia.

2. The method as defined in claim 1 wherein the tape is an elongated strip of tape and further comprising:

e. indexing the tape after debossing by distance sufficient to remove the sheared portion of tape from between the indicia die means and the metal substrate, wherein the metal substrate may be indexed or replaced and the method repeated.

3. The method as defined in claim 1 further comprising:

e. applying lubricant to the indicia die means to prevent the tape from adhering to the indicia die means.

4. The method as defined in claim 1 and further comprising:

e. thereafter heat treating the tape applied to the surface of the debossed indicia formed on the metal substrate to permanently affix the tape to the surface of the debossed indicia by means of the thermoset adhesive.

5. The method as defined in claim 4 wherein the heat treating is accomplished by passing the tape applied to the surface of the debossed indicia formed on the metal substrate under at least one infrared lamp.

* * * * *

UNITED STATES PATENT AND TRADEMARK OFFICE

CERTIFICATE OF CORRECTION

PATENT NO. : 4,073,671

DATED : February 14, 1978

INVENTOR(S) : Aurelio William Licata

It is certified that error appears in the above-identified patent and that said Letters Patent are hereby corrected as shown below:

Column 6, line 51 (claim 1, line 21), delete --positioned-- before "adhered".

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*